US006420949B1

(12) United States Patent
Umemoto et al.

(10) Patent No.: US 6,420,949 B1
(45) Date of Patent: Jul. 16, 2002

(54) CORE OF SOLENOID ACTUATOR

(75) Inventors: Atsushi Umemoto; Kenji Abe; Hisao Sakai; Chihaya Sugimoto, all of Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/695,301

(22) Filed: Oct. 25, 2000

(30) Foreign Application Priority Data

Oct. 27, 1999 (JP) ..... 11-306125

(51) Int. Cl.[7] ..... H01F 3/00

(52) U.S. Cl. ..... 335/251; 335/255; 336/234; 336/210

(58) Field of Search ..... 335/251–255, 335/257–269; 251/129.01, 129.15; 336/234, 210

(56) References Cited

U.S. PATENT DOCUMENTS

H575 H * 2/1989 Kerfoot et al. ..... 336/219
6,157,277 A * 12/2000 Bulgatz et al. ..... 335/220

FOREIGN PATENT DOCUMENTS

JP 57-95610 * 6/1982

* cited by examiner

*Primary Examiner*—Lincoln Donovan
*Assistant Examiner*—Tuyen T. Nguyen
(74) *Attorney, Agent, or Firm*—Arent Fox Kitner Plotkin & Kahn

(57) ABSTRACT

A core of a solenoid actuator is provided which is improved in durability, and at the same time ensures high energy efficiency of the solenoid actuator. The core of the solenoid actuator attracts an armature during operation of the solenoid actuator. A plurality of core plates are formed of a magnetically soft material and laminated in a predetermined direction orthogonal to a direction of attracting the armature to form a laminated stack. The core plates form magnetic circuits between the armature and the core plates themselves during the operation of the solenoid actuator. Two core holders formed of a non-magnetic material sandwiches the laminated stack of the plurality of core plates from opposite sides along the predetermined direction. The plurality of core plates are each coated with insulating film, which insulate adjacent two core plates from each other. Further, a rod formed of a non-magnetic material rigidly secures the plurality of core plates and the two core holders to each other to form a unitary assembly. The plurality of core plates are each formed with at least one projection projecting outward from a surface thereof and at least one recess formed in a reverse side of the at least one projection. The at least one projection of one of the each adjacent two core plates is fitted in the at least one recess of another of the each adjacent two core plates such that the each adjacent two core plates are inhibited from relative movement with respect to each other in the direction of attracting the armature.

4 Claims, 10 Drawing Sheets

CORE OF SOLENOID ACTUATOR

BACKGROUND OF THE INVENTION

1. Field of the Invention

This invention relates to a core of a solenoid actuator for electromagnetically driving a driven member, and more particularly to a multilayer core formed by a laminated stack of a plurality of magnetic plates.

2. Description of the Prior Art

Conventionally, a solenoid actuator of this kind has been proposed e.g. by Japanese Laid-Open Patent Publication (Kokai) No. 11-273945, which is applied to a valve-actuating mechanism for opening/closing a valve (gas exchange valve) of an internal combustion engine, and includes an armature and upper and lower electromagnets for vertically attracting the armature.

Each of the electromagnets includes a core having an E shape in cross section. The recessed portions of the E-shaped core serve as a coil groove opposed to the armature and accommodating a coil. The core is a unitary assembly formed of a center core member and a multiplicity of laminates stacked on opposite sides of the center core member. The center core member is formed of silicon steel which is larger in thickness than each laminate and has an E shape in side view. The laminates are each formed of a composite magnetically soft material having the same shape and size as those of the side face of the center core member and are stacked on the opposite sides of the center core member as described above. The center core member and the multiplicity of laminates are welded together to form the unitary component, and the end faces of the center core member and the laminates opposed to the armature form a flat attracting surface for receiving the magnetically attracted armature thereat. The reason why the core (laminated core) having the multilayer construction described above is employed is that it is possible to reduce core loss during energization of the electromagnet compared with the case of a solid core is used, thereby ensuring high energy efficiency.

The armature is connected to the valve via a shaft, and during operation of the solenoid actuator, the armature is attracted alternately by the upper and lower electromagnets to reciprocate vertically to open and close the valve. The armature attracted by the upper and lower electromagnets during the operation of the solenoid actuator is brought into abutment with the attracting surfaces of the cores of the electromagnets.

Therefore, the above conventional cores of the solenoid actuator suffer from the problem that impact of the abutment of the armature on each core during operation of the solenoid actuator can cause weld crack, thereby causing deformation and breakage of the laminates, which results in malfunction of the solenoid actuator. Further, laminates at opposite ends of the core, which are formed of the magnetically soft material, generate magnetic fields between magnetically soft components around the core and themselves during energization of the electromagnet, whereby part of energy of the electromagnet is lost.

SUMMARY OF THE INVENTION

It is an object of the invention to provide a core of a solenoid actuator, which is improved in durability, and at the same time ensures high energy efficiency of the solenoid actuator.

To attain the above object, the present invention provides a core of a solenoid actuator, for attracting an armature during operation of the solenoid actuator, comprising:

a plurality of core plates made of a magnetically soft material and stacked in a predetermined direction orthogonal to a direction of attracting the armature to form a laminated stack, for forming magnetic circuits between the armature and the core plates themselves during the operation of the solenoid actuator;

two core holders formed of a non-magnetic material and sandwiching the laminated stack of the plurality of core plates from opposite sides along the predetermined direction;

an insulator interposed between each adjacent two of the plurality of core plates, for insulating the each adjacent two core plates from each other; and fixing means formed of a non-magnetic material and rigidly securing the plurality of core plates and the two core holders to each other to form a unitary assembly, wherein the plurality of core plates are each formed with at least one projection projecting outward from a surface thereof and at least one recess each formed in a reverse side of each of the at least one projection, the at least one projection of one of the each adjacent two core plates being fitted in the at least one recess of another of the each adjacent two core plates such that the each adjacent two core plates are inhibited from relative movement with respect to each other in the direction of attracting the armature.

According to this core (including a yoke forming a magnetic circuit between the armature and the yoke itself) of a solenoid actuator, since the plurality of core plates simply stacked in one direction and the two core holders are secured to each other to form a unitary assembly, in a state of the plurality of core plates being sandwiched between the two core holders, the core can be made simpler in construction than the conventional ones, which contributes to reduction of manufacturing costs. Further, projections of one core plate are fitted in recesses of another core plate adjacent thereto such that the two adjacent core plates are inhibited from relative movement with respect to each other in the direction of attracting the armature, so that even if the plurality of core plates receive an impact caused by e.g. abutment of the armature on the core during operation of the solenoid actuator, the core plates cannot be displaced with respect to each other in a direction in which the armature moves, and hence it is possible to prevent breakage of each core plate, thereby enhance the durability of the same. Further, the projections and recesses can be used for positioning the plurality of core plates with respect to each other in assembling them into a laminated stack, which facilitates the assembly work of the laminated stack. Further, according to the core of the invention, since the plurality of core plates are stacked in the predetermined direction orthogonal to the direction of attracting the armature, in a state insulated from each other by the insulators, a magnetic circuit is formed between each core plate and the armature during the operation of the solenoid actuator, and at this time, an eddy current is generated in each core plate. However, since the core of the invention is formed by the plurality of core plates each of which is thinner than an ordinary solid core, the eddy current generated in each core plate disappears more promptly than in the solid core. Moreover, since the two core holders at the opposite ends of the core are formed of the non-magnetic material, magnetic fields are not readily generated between the core and magnetically soft components around the core during operation of the solenoid actuator, which contributes to reduction of energy loss. Thus, the core of the invention makes it possible to ensure high energy efficiency of the solenoid actuator.

Preferably, the laminated stack of the plurality of core plates is formed with at least one through hole extending therethrough in the predetermined direction, and the fixing means comprises at least one rod each extending through a corresponding one of the at least one through hole and fixed to the two core holders.

According to this preferred embodiment, since displacement of the core plates with respect to each other in the direction in which the armature moves is prevented not only by the fitting of the projections of each core plate in the recesses of its adjacent core plate, but also by at least one rod extending through the laminated stack of the plurality of core plates, it is possible to prevent breakage of each core plate more positively and further enhance the durability of the same.

Preferably, an upper face of the laminated stack of the plurality of core plates is lower than upper faces of the two core holders by a predetermined height.

According to this preferred embodiment, when the armature is attracted by the core of the solenoid actuator, the armature is brought into abutment with the two core holders alone, without being brought into contact with the plurality of the core plates, so that most of impact caused by the abutment of the armature on the core can be received by the core holders.

Preferably, each of the plurality of core plates has a whole surface thereof coated with an insulating film, and the insulator is formed by corresponding portions of the insulating films of the each adjacent two of the plurality of core plates.

According to this preferred embodiment, an eddy current generated in each core plate during operation of the solenoid actuator is inhibited by the insulating films from flowing to its adjacent core plates and disappears promptly within the thin core plate.

Further, the non-magnetic material forming the two core holders and the fixing means is an austenitic stainless steel having stiffness.

According to this preferred embodiment, since the core holders and the fixing means are each formed of an austenitic stainless steel having stiffness, they cannot be deformed even if they receive the impact caused by the abutment of the armature on the core.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof. In the embodiment, a solenoid actuator having cores according to the invention is applied to a valve-actuating mechanism of a vehicle engine, not shown, having four valves per cylinder.

Figure 1:
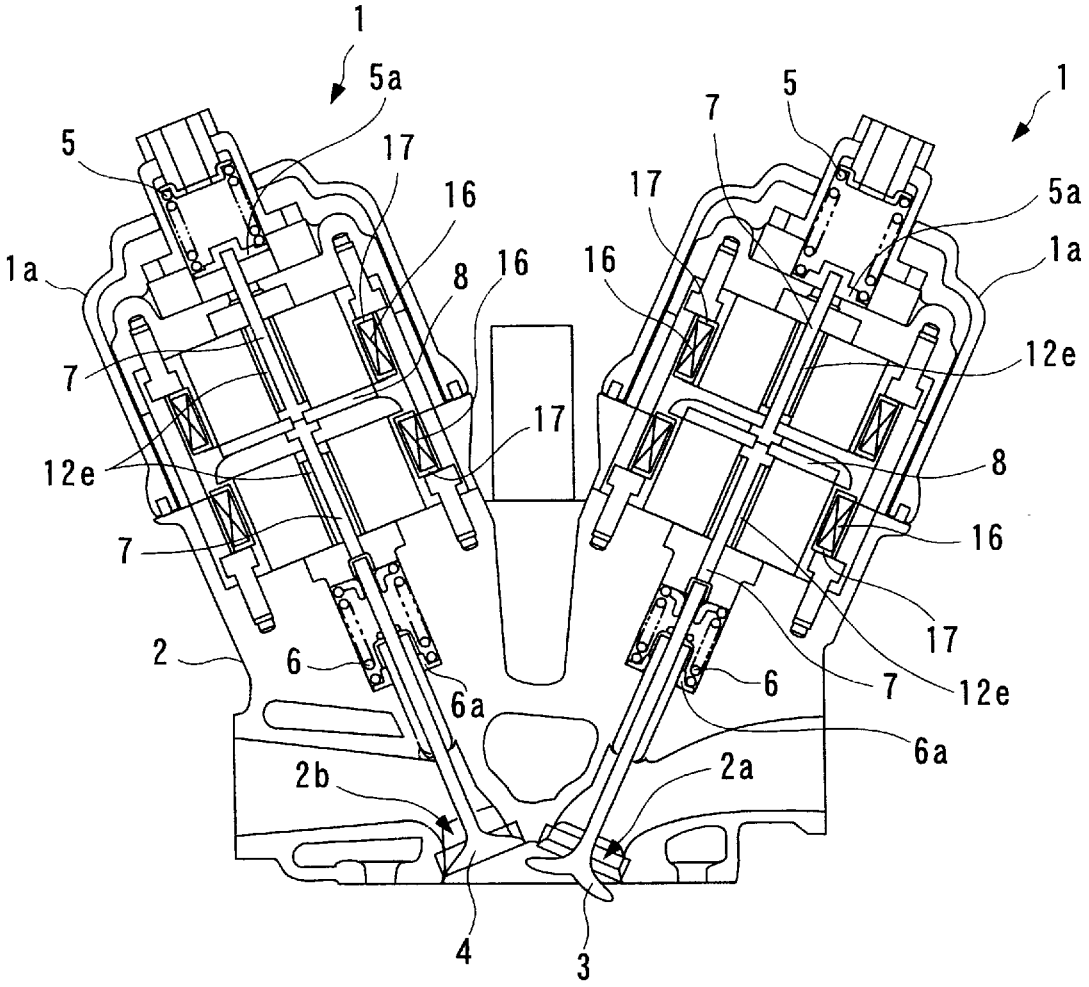
FIG. 1 is a sectional view of a valve-actuating mechanism of a vehicle engine to which is applied a solenoid actuator having cores according to an embodiment of the present invention.

Referring first to FIG. 1, the valve-actuating mechanism is comprised of a pair of solenoid actuators 1, 1 mounted in a cylinder head 2 of the vehicle engine. During operation of the engine, the solenoid actuator 1 arranged on the right-hand side as viewed in the figure drives two intake valves 3, 3 (only one of them is shown in the figure), thereby opening and closing two intake ports 2*a*, 2*a* (only one of them is shown in the figure) of the engine, while the solenoid actuator 1 arranged on the left-hand side as viewed in the figure drives two exhaust valves 4, 4 (only one of them is shown in the figure), thereby opening and closing two exhaust ports 2*b*, 2*b* (only one of them is shown in the figure) of the same.

These two solenoid actuators 1, 1 are identical in construction to each other, so that the following description will be made by taking the right-hand solenoid actuator 1 for driving the intake valves 3 as an example. Further, for convenience of description, sides indicated by B and B' of a two-headed arrow B–B' in FIG. 2 are referred to as the "front" side and the "rear" side, respectively, while sides indicated by C and C' of a two-headed arrow C–C' are referred to as the "left" side and the "right" side, respectively.

Figure 2:
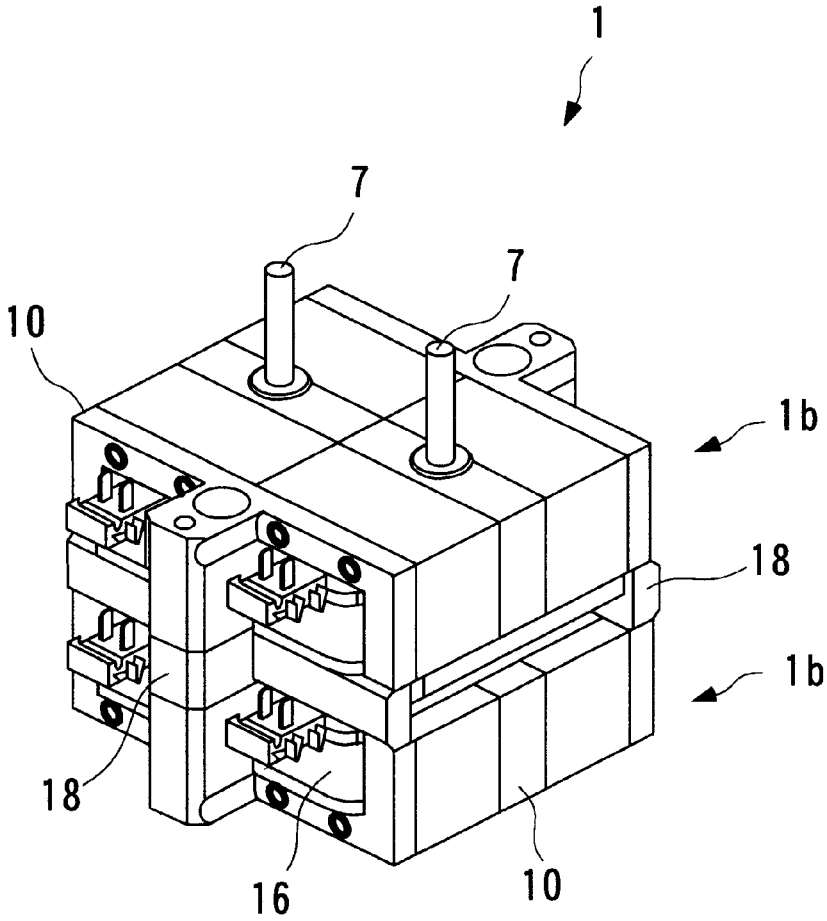
FIG. 2 is a perspective view of the solenoid actuator appearing in FIG. 1.
Figure 2:
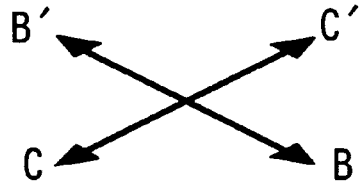
Figure 3:
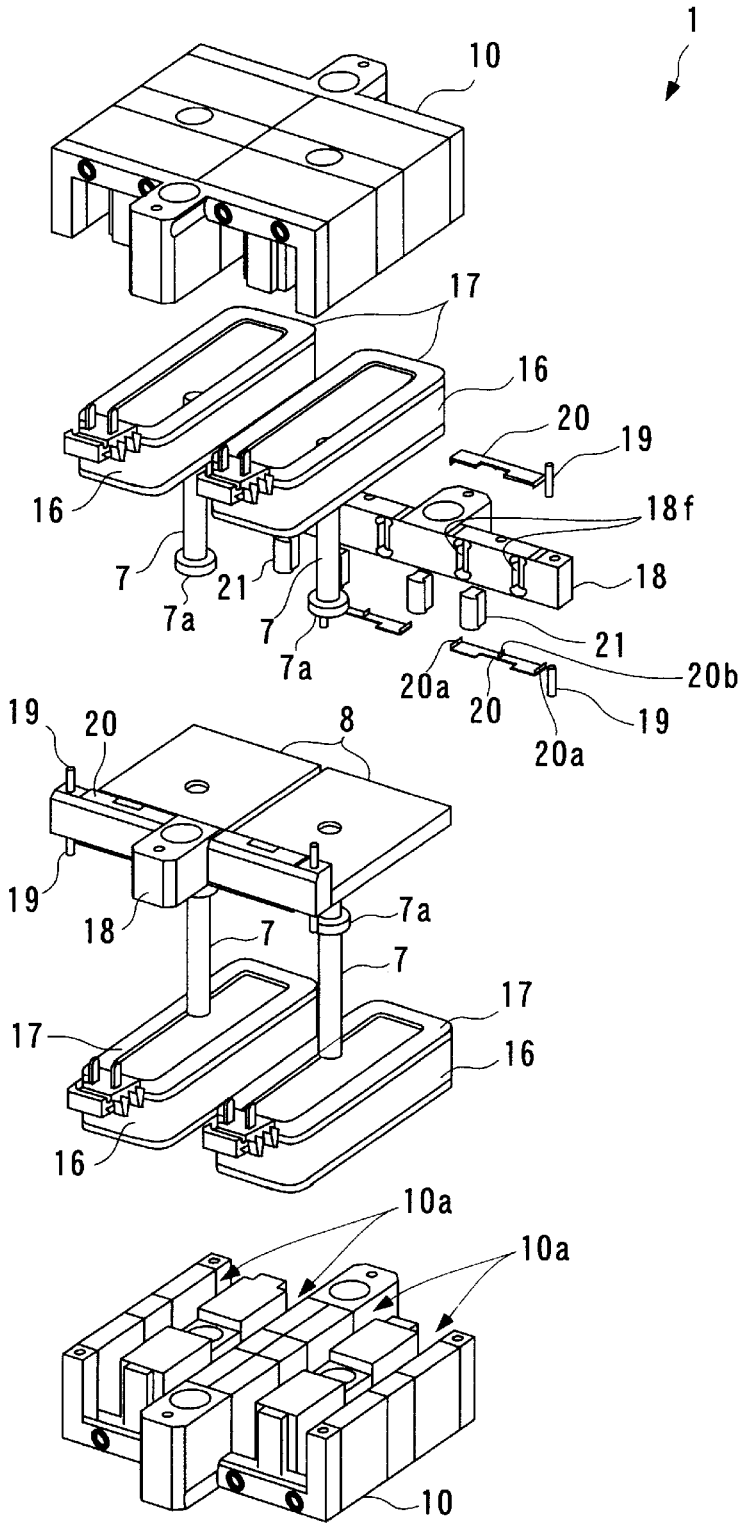
FIG. 3 is an exploded perspective view of FIG. 2 solenoid actuator.

As shown in FIGS. 1 to 3, the solenoid actuator 1 has its front and rear halves constructed symmetrically to each other in the front-rear direction, and the two intake valves 3, 3 are driven by the respective front and rear halves of the solenoid actuator 1. More specifically, the solenoid actuator 1 includes a casing 1*a* (see FIG. 1) mounted in the cylinder head 2, upper and lower electromagnets 1*b*, 1*b* arranged within the casing 1*a* with a predetermined distance therebetween, two armatures 8, 8 arranged within a space between the upper and lower electromagnets 1*b*, 1*b* in a vertically slidable manner, two upper coil springs 5, 5 (only one of them is shown in FIG. 1) for constantly urging the respective armatures 8, 8 downward, and two lower coil springs 6, 6 (only one of them is shown in the figure) for constantly urging the respective armatures 8, 8 upward.

Figure 7A:
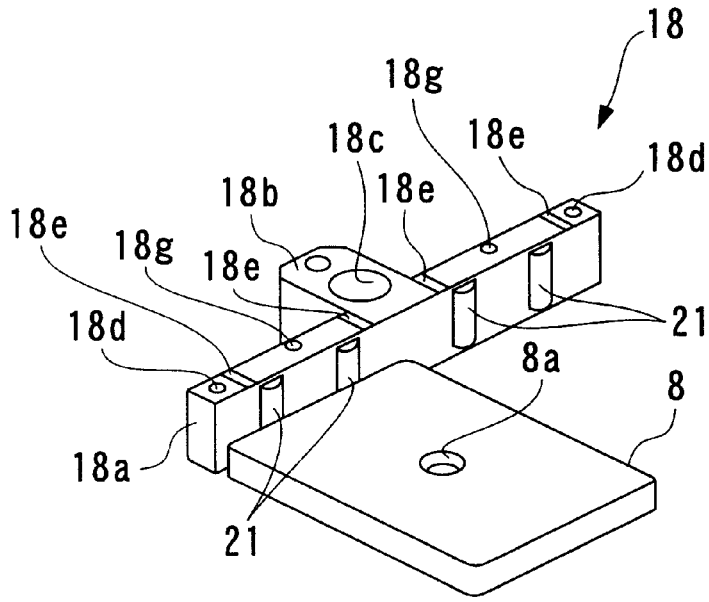
FIG. 7A is a perspective view of a joint and an armature of the FIG. 2 solenoid actuator.
Figure 7B:
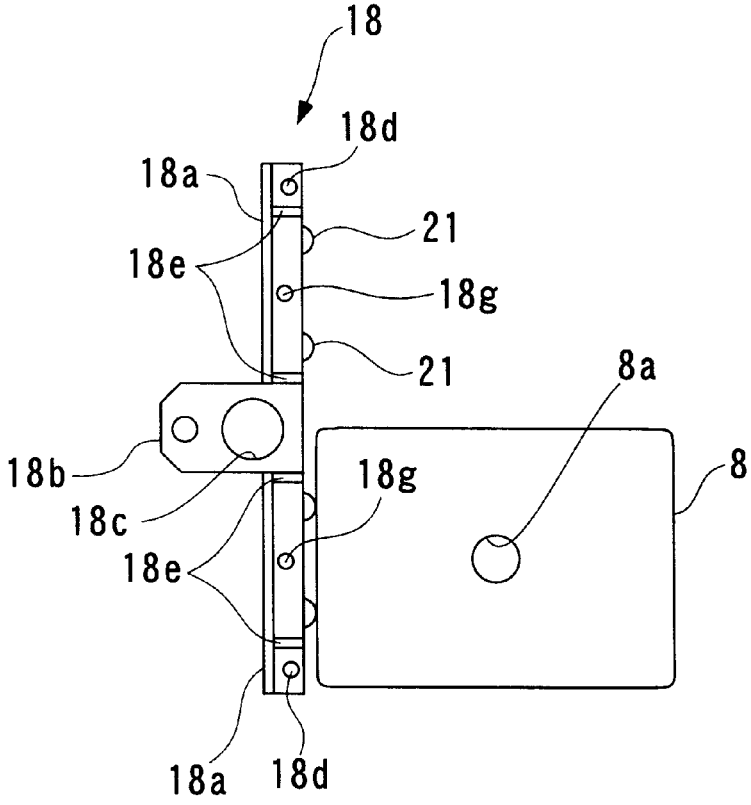
FIG. 7B is a plan view of the joint and the armature of FIG. 7A.

The armatures 8 are rectangular plates each formed of a magnetically soft material (e.g. steel) and having a round through hole 8*a* formed vertically through a center thereof as shown in FIGS. 7A and 7B. Each of the armatures 8 has left and right end faces thereof held in contact with armature guides 21 of joints 18, referred to hereinafter. The armature 8 moves vertically in a manner guided by the armature guides 21. Further, connected to the armature 8 are upper and lower shafts 7, 7 which are round in cross section and formed of a non-magnetic austenitic stainless steel. The upper end of the lower shaft 7 and the lower end of the upper shaft 7 are fitted in the round through hole 8*a* of the armature 8. The armature 8 is supported in a sandwiched manner by flanges 7*a*, 7*a* formed on the upper and lower shafts 7, 7 at locations close to the lower and upper ends of the respective upper and lower shafts 7, 7.

The lower shaft 7 extends vertically through a guide 12*e* of a central core holder 12, referred to hereinafter, of the lower electromagnet 1*b*, and the lower end of the lower shaft 7 is connected to the upper end of the intake valve 3. Similarly, the upper shaft 7 extends vertically through a guide 12*e* of a central core holder 12 of the upper electromagnet 1*b*. The upper shaft 7 is held in contact with the upper coil spring 5 via a spring-seating member 5*a* mounted on the upper end of the upper shaft 7. The shafts 7 are guided through the guides 12*e*, respectively, whenever the armature 8 moves vertically. The intake valve 3 is held in contact with the lower coil spring 6 via a spring-seating member 6*a* mounted on the upper end of the intake valve 3.

As shown in FIGS. 2 and 3, the upper and lower electromagnets 1*b*, 1*b* are connected to each other via the joints 18 referred to hereinafter. The electromagnets 1*b*, 1*b* are identical in construction and arranged in a vertically symmetrical manner with the joints 18 interposed therebetween. In the following, description is made by taking the lower electromagnet 1*b* as an example.

Figure 4A:
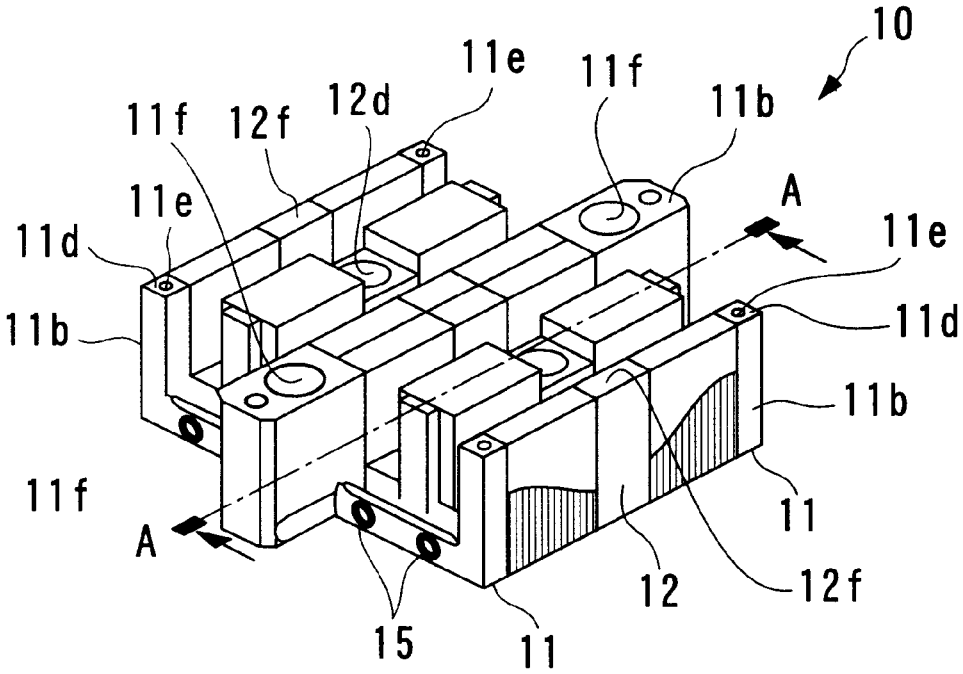
FIG. 4A is a perspective view of a core of the solenoid actuator appearing in FIG. 3.
Figure 4B:
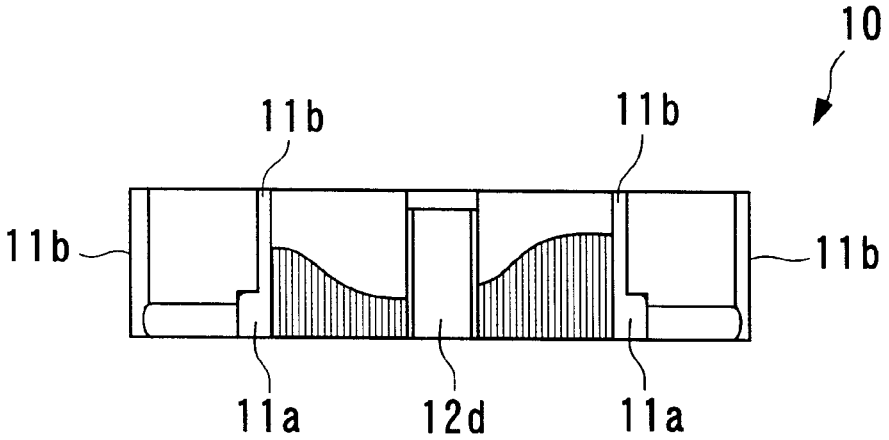
FIG. 4B is a sectional view taken on line A—A of FIG. 4A.
Figure 5:
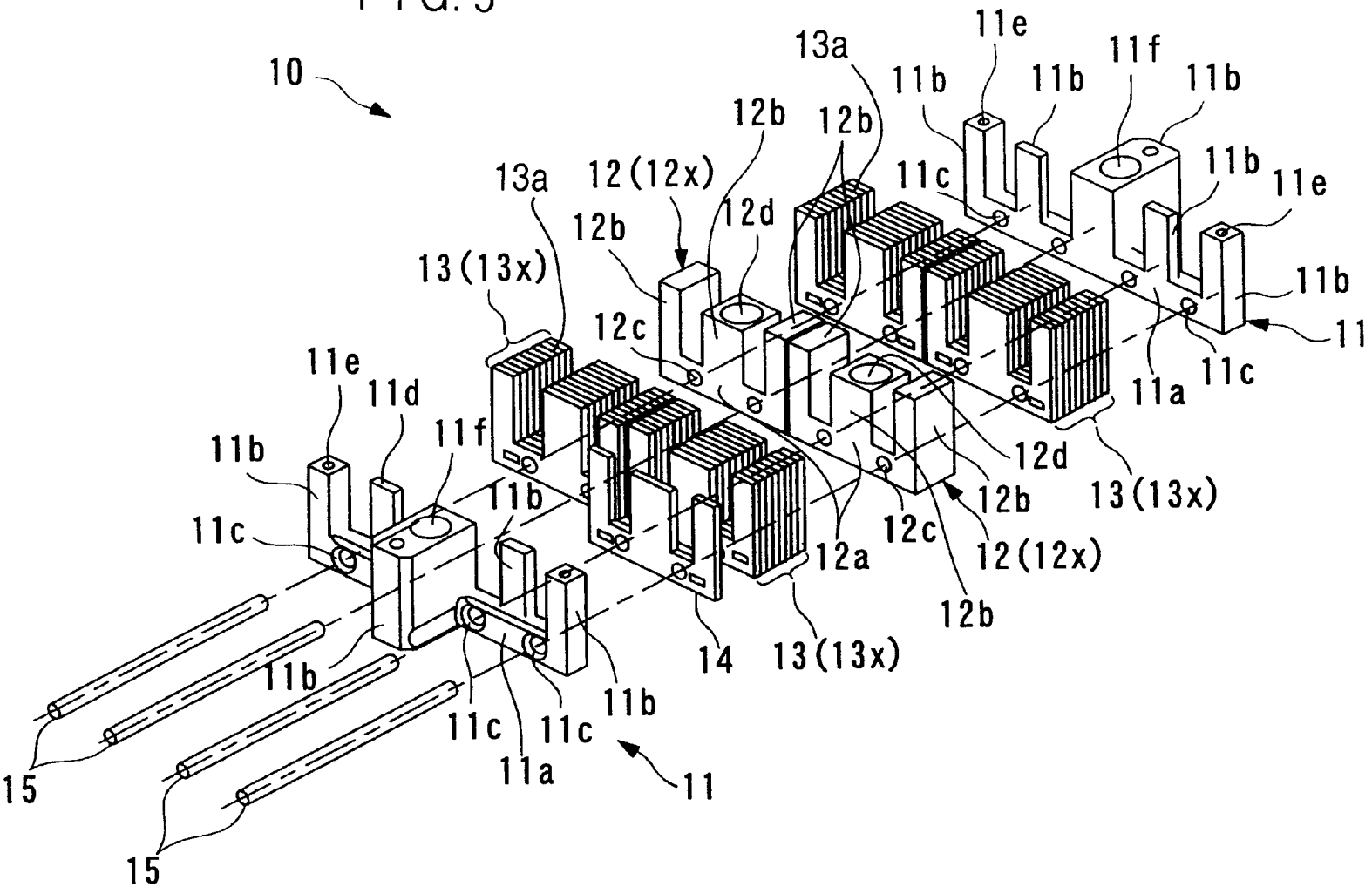
FIG. 5 is an exploded perspective view of the core shown in FIGS. 4A and 4B.

The lower electromagnet 1*b* includes a core 10 and two coils 16, 16 accommodated in respective coil grooves 10*a*, 10*a* formed in the core 10 (see FIG. 3). As shown in FIGS. 4A, 4B and 5, the core 10 is a unitary assembly formed by combining three core holders, i.e. left and right core holders 11, 11 and a central core holder 12, and left and right laminated stacks 13, 13 of core plates 14 by four rods (fixing means) 15.

The left and right core holders 11, 11 are each formed of the austenitic stainless steel similarly to the shafts 7. The two core holders 11, 11 are identical in construction and arranged in a manner symmetrically opposed to each other in the left-right direction. The following description is made by taking the left core holder 11 as an example. The left core holder 11 is a unitary comb-shaped member comprised of a base portion 11*a* extending in the front-rear direction and five retainer portions 11*b* each formed to have a shape of a hair comb tooth and extending upward from the base portion 11*a* to a predetermined height in a manner spaced from each other in the front-rear direction.

Each of the five retainer portions 11*b* is rectangular in cross section and has a right side face thereof flush with the right side face of the base portion 11*a*. On the other hand, the left side face of the middle retainer portion 11*b* protrudes outward or leftward with respect to the left side face of the base portion 11*a*, the left side faces of the respective front and rear retainer portions 11*b*, 11*b* are flush with that of the base portion 11*a*, and those of the inner retainer portions 11*b*, 11*b* formed between the middle retainer portion 11*b* and the respective front and rear retainer portions 11*b*, 11*b* are slightly recessed inward or rightward from the base portion 11*a*. It should be noted that the middle retainer portion 11*b* is formed by integrating a portion protruding outward or leftward from the base portion 11*a*.

Formed in respective predetermined portions of the base portion 11*a* are four through holes 11*c* each extending in the left-right direction and having a left-side opening chamfered. Further, the front and rear retainer portions 11*b* each have an upper face thereof formed with a round hole 11*e* open upward, and the middle retainer portion 11*b* is formed with a through hole 11*f* extending vertically.

The central core holder 12 is also formed of the same austenitic stainless steel as that of the core holder 11. The central core holder 12 extends in the front-rear direction and has the same length along this direction as that of the core holder 11. Further, the central core holder 12 has a comb-like shape in side view, which is substantially the same as the shape of the core holder 11. The central core holder 11 is formed by joining two holder members 12X, 12X to each other in the front-rear direction and has opposite flat side faces. Each of the holder members 12X has an E shape in cross section and has a base portion 12a extending in the front-rear direction, and three retainer portions 12*b*, 12*b*, 12*b* integrally formed with the base portion 12*e* and extending upward, respectively, from the front and rear ends and a central portion of the base portion 12*a*. The base portion 12*a* is formed therethrough with two through holes 12*c*, 12*c* extending in the left-right direction. The front and rear retainer portions 12*b*, 12*b* are identical in height to the retainer portions 11*b* of the core holder 11, and the middle retainer portion 12*b* is lower than the other retainer portions 12*b*, 12*b*. This enables the upper face of the central retainer portion 12*b* to serve as an indentation for receiving the flange 7*a* of the shaft 7 when the armature 8 is brought into abutment with the core 10 (see FIG. 1).

Further, the middle retainer portion 12*b* is formed therethrough with a through hole 12*d* extending vertically, in which is fitted the hollow cylindrical guide 12*e* (see FIG. 1) for guiding vertical sliding motion of the shaft 7.

The central core holder 12 is formed by joining the front retainer portion 12*b* of one of the holder members 12X, 12X constructed as above to the rear retainer portion 12*b* of the other. The two retainer portions 12*b*, 12*b* joined to each other to form the central portion of the central core holder 12 are opposed to the middle retainer portion 11*b* of the core holder 11. Similarly, the opposite front and rear retainer portions 12*b*, 12*b* of the central core holder 12 other than the two retainer portions 12*b*, 12*b* forming the central portion are opposed to the front and rear retainer portions 11*b*, 11*b* of the core holder 11, respectively, while the middle retainer portions 12*b*, 12*b* are opposed to the inner retainer portions 11*b*, 11*b*, respectively. Further, the four through holes 12*c* are identical in diameter to the four through holes 11*c* formed through the core holder 11, respectively, and each opposed to the corresponding one of the four through holes 11*c*.

Figure 6A:
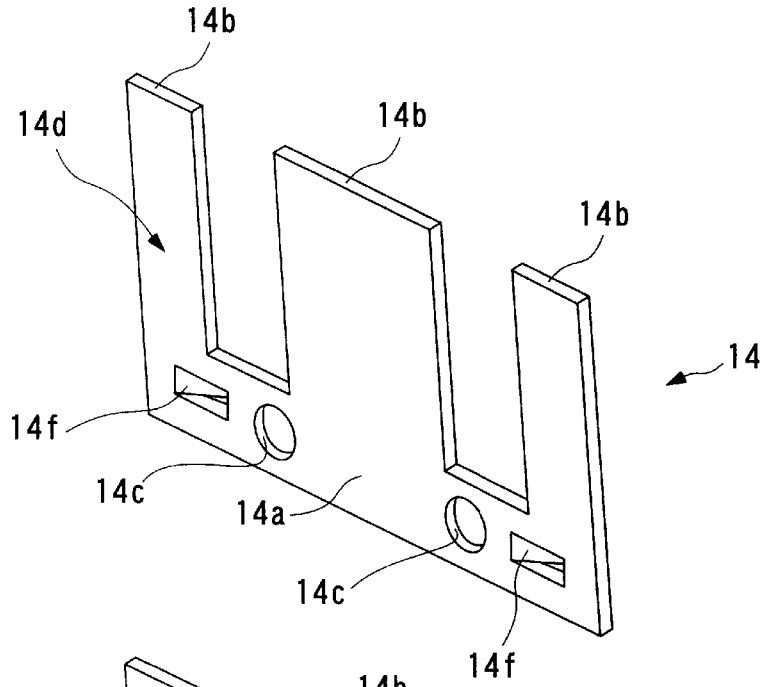
FIG. 6A is a perspective view of a core plate as a component of the core shown in FIGS. 4A and 4B.
Figure 6B:
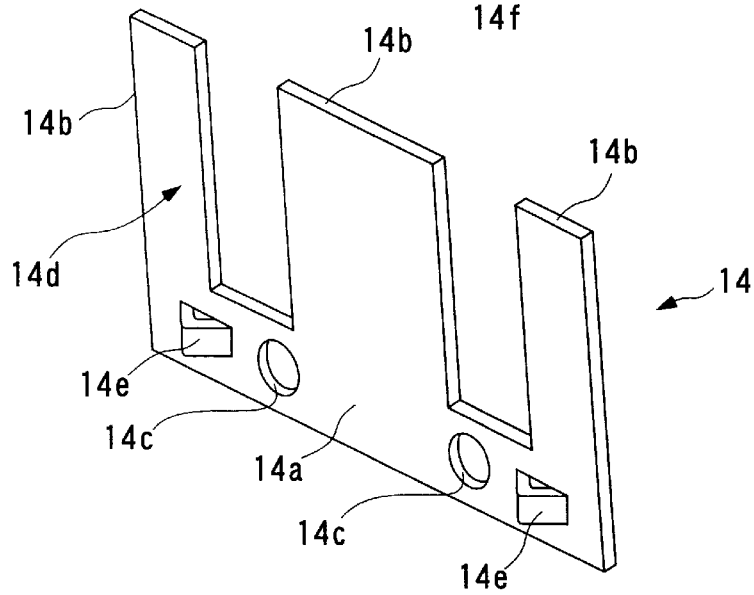
FIG. 6B is a perspective view showing the opposite side of the FIG. 6A core plate.
Figure 6C:
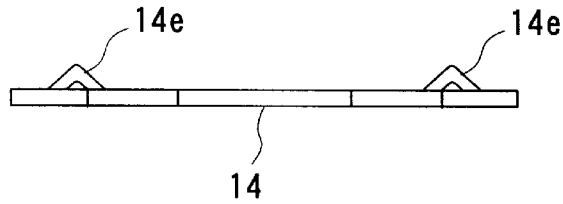
FIG. 6C is a plan view of the core plate.

The laminated stacks 13 are each comprised of a pair of laminated stacks 13X, 13X of core plates 14 arranged in the front-rear direction. Each laminated stack 13X of core plates 14 is formed by laminates of a predetermined number of core plates 14, one of which is shown in FIGS. 6A to 6C, in the left-right direction. Each core plate 14 is formed of a thin non-oriented silicon steel plate and has the whole surface thereof coated with an insulating film (insulating material)

14*d* e.g. of epoxy resin. Adjacent ones of the core plates 14 are insulated from each other by the insulating films 14*d*. Further, the core plate 14 is formed to have substantially the same E shape and size as those of the side face of the holder member 12X, by stamping a non-oriented silicon steel plate. More specifically, the core plate 14 is comprised of a base portion 14*a* extending in the front-rear direction and three magnetic path-forming portions 14*b*, 14*b*, 14*b* extending upward, respectively, from the front and rear ends and central portion of the base portion 14*a*, the base portion 14*a* being formed with two through holes 14*c*, 14*c* open in the left-right direction.

The three magnetic path-forming portions 14*b* are identical in height to each other, and lower than the front and rear retainer portions 12*b* of the central core holder 12 by a predetermined height (e.g. equal to or smaller than 20 $\mu$m), so that an upper face 13*a* of the laminated stack 13X is lower than the upper face 11*d* of the core holder 11 and an upper face 12*f* of the central core holder 12 (see FIG. 10). The corresponding through holes 14*c* of the respective core plates 14 are continuous with each other to form a through hole extending through the laminated stack 13X in the left-right direction. Further, the through holes 14*c* are each identical in diameter to the corresponding through hole 11*c* of the core holder 11 and the corresponding through hole 12*c* of the core holder 12 and positioned in a manner concentric with the corresponding through holes 11*c* and 12*c*. Further, the base portion 14*a* is formed with two projections 14*e*, 14*e* at opposite locations slightly laterally outward of the respective through holes 14*c*, 14*c*. Each projection 14*e* having a V shape in plan view is projected rightward from the base portion 14*a*, and a recess 14*f* is formed in a reverse side of each projection 14*e*.

The projections 14*e* of one core plate 14 are each fitted in the corresponding recess 14*f* of another core plate 14 adjacent thereto in the rightward direction, whereby the core plates 14 are all held in a closely stacked state. Further, the core plate 14 positioned at the right end of the laminated stack 13X is formed not with the projections 14*e* and recesses 14*f*, but only with horizontally elongated rectangular holes, not shown, in which are fitted the respective corresponding projections 14*e* of the left-hand adjacent core plate 14. Therefore, the right end face of the laminated stack 13X is flat, so that it is in intimate contact with the central core holder 12 or the right core holder 11.

Each of the rods 15 is a round bar which is slightly smaller in diameter than the through holes 11*c*, 12*c*, 14*c*. The rods 15 are each fitted through the corresponding through holes 11*c*, 12*c*, 14*c* and extend in the left-right direction. The right and left end portions of each rod 15 projecting from the through holes 11*c*, 11*c*, respectively, are swaged on the outer end faces of the respective base portions 11*a* of the right and left core holders 11. Thus, the left-hand laminated stack 13 is sandwiched between the left core holder 11 and the central core holder 12, while the right-hand laminated stack 13 is sandwiched between the central core holder 12 and the right core holder 11, whereby these members are rigidly secured to each other to form the core 10.

The coils 16, 16 are each formed to have a horizontally elongated annular or toroidal shape and assembled with bobbins 17, 17 into a unitary assembly. Each bobbin 17 is formed of a synthetic resin and has a wall U-shaped in cross section for receiving a corresponding one of the coils 16, 16 therein. The bobbins 17, 17 are accommodated in the two coil grooves 10*a*, 10*a*, respectively. Each coil groove 10*a* is defined by the retainer portions 11*b* of the core holders 11, the retainer portions 12*b* of the central core holder 12, and the magnetic path-forming portions 14*b* of the core plates 14. Each of the coils 16, 16 is accommodated within the annular coil groove 10*a* in a manner enclosing the members positioned inside the annular coil groove 11*a*, i.e. the inner retainer portions 11*b* of the opposite core holders 11, the middle retainer portion 12*b* of the central core holder 12, and the middle magnetic path-forming portions 14*b*.

Figure 8A:
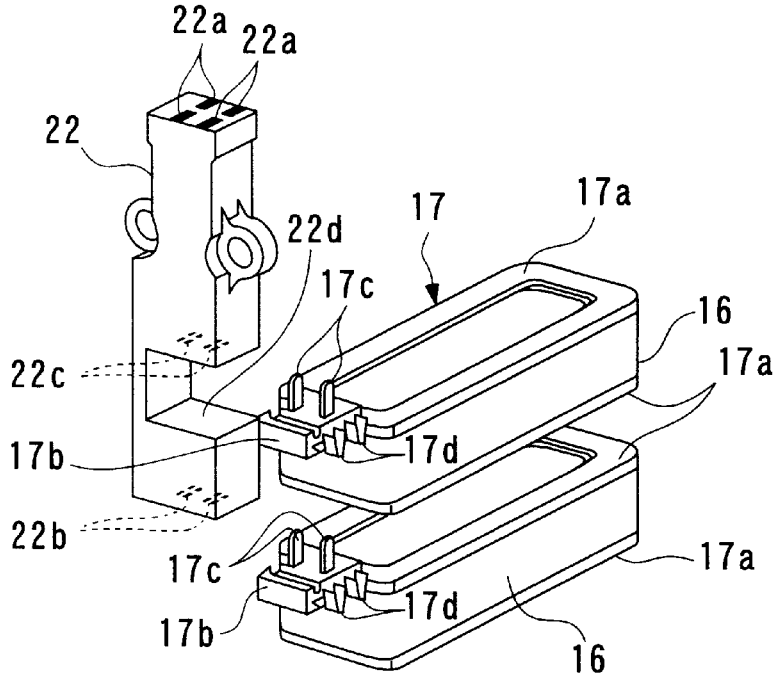
FIG. 8A is a perspective view of bobbins each bearing its associated components and a connector of the FIG. 2 solenoid actuator before they are assembled.
Figure 8B:
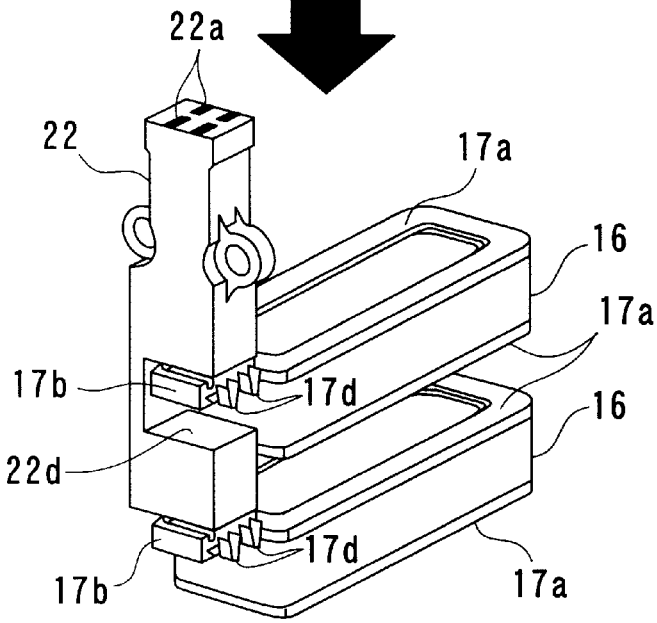
FIG. 8B is a perspective view of the bobbins each bearing its associated components and the connector of the FIG. 2 solenoid actuator after they are assembled.

As shown in FIGS. 8A and 8B, the bobbin 17 is comprised of upper and lower brims 17*a*, 17*a*, a terminal portion 17*b* projecting leftward from the left end of the upper brim 17*a*, a pair of front and rear terminals 17*c*, 17*c* projecting upward from the terminal portion 17*b*, and a pair of V-shaped metal connectors 17*d*, 17*d* connected to the terminals 17*c*, 17*c*. The front and rear terminals 17*c*, 17*c* are each formed of an electrically conductive metal plate and arranged such that principal planes thereof are positioned in a manner parallel and opposed to each other in the front-rear direction. The coil 16 is wound around the bobbin 17 between the upper and lower brims 17*a*, 17*a*, and the ends of the coil 16 are connected to the metal connectors 17*d*, 17*d*, respectively, to be electrically connected to the respective two terminals 17*c*, 17*c*.

The lower electromagnet 1*b* is constructed as above, and the upper electromagnet 1*b* is identical in construction to the lower electromagnet 1*b*. Further, as shown in FIGS. 2, 3 and 7A, 7B, the upper and lower electromagnets 1*b*, 1*b* are joined to each other by a pair of left and right joints 18, 18. The two joints 18, 18 are arranged in a manner symmetrically opposed to each other in the left-right direction. Each of the joints 18 is formed of an austenitic stainless steel and extends in the front-rear direction such that it has the same length as that of the core holder 11. The joint 18 has substantially the same shape in plan view as that of the core holder 11. More specifically, the joint 18 is comprised of a base portion 18*a* extending in the front-rear direction and a protrusion 18*b* integrally formed with the base portion 18*a* and protruding outward from the central portion of the same.

The protrusion 18*b* is formed with a vertical through hole 18*c* which is identical in diameter to the through hole 11*f* of the middle retainer portion 11*b* of the core holder 11 and positioned in a manner concentric with the same.

The base portion 18*a* is identical in height to the protrusion 18*b* and has round holes 18*d*, 18*d* formed, respectively, in the opposite end portions of the upper face thereof as well as round holes 18*d*, 18*d* formed, respectively, in the opposite end portions of the lower face thereof. Each round hole 18*d* is identical in diameter and concentric with the corresponding round hole 11*e* of the core holder 11. Fitted in each of the round holes 18*d* is half of a pin 19 in the form of a round rod formed of an austenitic stainless steel, and the other half of the pin 19 is fitted in the round hole 11*e*, whereby the upper and lower cores 10, 10 are coupled to each other via the joints 18, 18.

Further, arranged on the upper face of the base portion 18*a* are front and rear coil-protecting buffer plates 20, 20 (see FIG. 3). The coil-protecting buffer plates 20, 20 are identical in shape to each other and arranged in a symmetrical manner in the front-rear direction, so that the following description will be made by taking the front coil-protecting buffer plate 20 as an example. The front coil-protecting buffer plate 20 is formed of a synthetic resin and smaller in width in the left-right direction than the base portion 18*a*. Further, the buffer plate 20 is formed with opposite end projections 20*a* and a central projection 20*b* projecting vertically (downward in this example) from the underside thereof. The base portion 18*a* has two groves 18*e* and a hole

18*g* formed at respective predetermined locations on the front-side portion of the upper face thereof, and the two opposite end projections 20*a* are fitted in the two grooves 18*e,* and the central projection 20*b* is fitted in the hole 18*g,* respectively, whereby the front coil-protecting buffer plate 20 is mounted on the base portion 18*a*. The rear coil-protecting buffer plate 20 is mounted on the base portion 18*a* in the same manner. Further, on the lower face of the base portion 18*a,* there are also mounted front and rear coil-protecting buffer plates 20, 20 in a similar manner.

Further, the four armature guides 21 are fixed to the inner surface of the joint 18 at predetermined space intervals, for guiding vertical movement of the armatures 8 (see FIGS. 7A, 7B). Each armature guide 21 is formed of the austenitic stainless steel and has a fitting portion which is rectangular in cross section and a guide portion integrally formed with the fitting portion and semicircular in cross section. The inner side surface of the joint 18 has four vertical grooves 18*f* formed at predetermined space intervals. The fitting portion 21*a* of each armature guides 21 is fitted in the corresponding vertical groove 18*f* whereby the armature guide 21 is fixed to the joint 18. In this state, each of the guide portions semicircular in cross section protrudes toward the armature 8 from the inner side surface of the joint 18 and at the same time held in contact with the left or right end face of the armature 8. Thus, the armatures 8 are each guided by the corresponding armature guides 21 when they are moved.

In a state where the upper and lower electromagnets 1*b,* 1*b* are joined to each other via the joint 18 constructed as above, each of the four coils 16 (bobbins 17) is vertically sandwiched by the corresponding core 10 and joints 18, as shown in FIG. 2, in a state of the brim 17*a* of the bobbin 17 in abutment with the corresponding coil-protecting buffer plate 20. The through hole 11*f* of each core 10 and the through hole 18*c* of each joint 18 extend vertically in a manner continuous with each other. A bolt, not shown, is screwed into the cylinder head 2 through these holes 11*f,* 18*c,* whereby the electromagnets 1*b,* 1*b* are rigidly fixed to the cylinder head 2.

Further, as shown in FIGS. 8A, 8B, the front (or rear) coil 16 and bobbin 17 of the upper electromagnet 1*b* and the front (or rear) coil 16 and bobbin 17 of the lower electromagnet 1*b* are arranged vertically in an identical position in plan view. The two terminals 17*c,* 17*c* of each of the two bobbins 17 are connected to a connector 22 which is generally in the form of a rectangular column. The connector 22 is formed of a synthetic resin and extends vertically.

The connector 22 has an upper end face thereof formed with four upper socket openings 22*a* each in the form of a slit and open upward, and a lower end face thereof formed with two lower socket openings 22*b,* 22*b* each identical in shape to the upper socket opening 22*a*. The two lower socket openings 22*b,* 22*b* are parallel and opposed to each other in the front-rear direction and open downward at respective locations corresponding to the terminals 17*c,* 17*c*. Further, formed in the lower end portion of the connector 22 is a cut-away portion 22*d* formed by cutting away a parallelepiped portion of the connector 22 from the front side of the same. The cut-away portion 22*d* has an upper wall thereof formed with two middle socket openings 22*c,* 22*c*. The middle socket openings 22*c,* 22*c* are open downward and identical in position in plan view to the respective lower socket openings 22*b,* 22*b*. Within each of the socket openings 22*a* to 22*c,* there is provided a metal connector, not shown, comprised of two electrically conductive metal strips arranged in a manner each extending vertically and combined such that root portions thereof are held in contact with each other and a space therebetween is increased toward the outer or forward ends thereof. The terminals 17*c* are each sandwiched by the metal strips of a corresponding one of the metal connectors in the socket openings 22*b,* 22*c*.

The metal connectors of the front two of the four upper socket openings 22*a* are electrically connected to the respective metal connectors of the middle socket openings 22*c,* 22*c,* while the metal connectors of the rear two of the four upper socket openings 22*a* are electrically connected to the respective metal connectors of the lower socket openings 22*b,* 22*b*. Further, a cable, not shown, having four terminals extends from a controller, not shown, and the four terminals of the cable are plugged into the four socket openings 22*a,* respectively, whereby the four coils 16 are electrically connected to the controller.

Next, the operation of the solenoid actuator 1 constructed as above is explained. In the solenoid actuator 1, the front half thereof and the rear half thereof operate similarly, so that description will be made by taking the operation of the front half as an example.

When neither of the upper and lower electromagnets 1*b,* 1*b* is energized, the front armature 8 is held in its neutral position between the upper and lower electromagnets 1*b,* 1*b* by the upper and lower coil springs 5 and 6. This causes the intake valve 3 to be in a halfway opened/closed position, not shown.

Figure 10A:
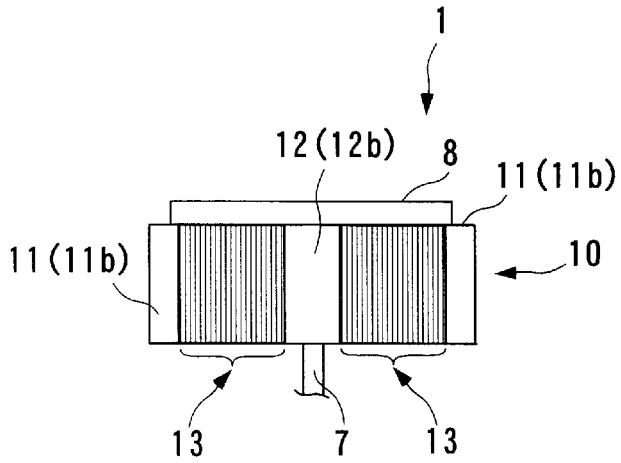
FIG. 10A is a front view showing a state of the armature attracted by an electromagnet during operation of the solenoid actuator, in which it is in abutment with the core.
Figure 10B:
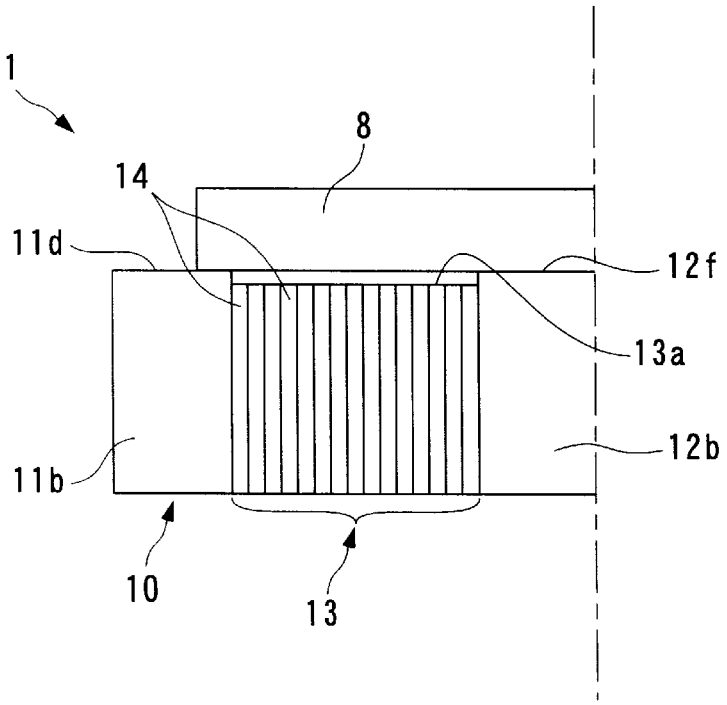
FIG. 10B is an enlarged view showing an essential portion of FIG. 10A.

When the lower electromagnet 1*b,* for instance, is energized in this state by electric power supplied from the controller, the armature 8 is attracted by the lower electromagnet 1*b,* whereby the armature 8 is moved downward against the urging force of the lower coil spring 6 to a position where it is brought into abutment with the core 10 of the lower electromagnet 1*b* (see FIGS. 10A, 10B). At this time, the upper and lower shafts 7, 7 slide downward in a manner guided by the guides 12*e,* 12*e* of the upper and lower cores 10, 10, respectively, and the armature 8 also slides downward while being guided by the armature guides 21 of the guide joints 18. This causes the intake valve 3 to open the intake port 2*a*.

Subsequently, when the energization of the lower electromagnet 1*b* is stopped, the armature 8 is moved upward by the urging force of the lower coil spring 6. Further, when the upper electromagnet 1*b* is energized at a predetermined timing, the armature 8 is attracted by the upper electromagnet 1*b,* whereby the armature 8 is moved upward against the urging force of the upper coil spring 5 to a position where it is brought into abutment with the core 10 of the upper electromagnet 1*b* (see the left-hand solenoid actuator 1 for driving the exhaust valves 4 in FIG. 1). This upward movement of the armature 8 causes the intake valve 3 to close the intake port 2*a*. Then, after stoppage of the energization of the upper electromagnet 1*b,* the lower electromagnet 1*b* is energized at a predetermined timing to cause the intake valve 3 to open the intake port 2*a,* similarly to the above. By repeatedly carrying out the above operations, the armature 8 is caused to vertically reciprocate between the upper and lower electromagnets 1*b,* 1*b,* thereby opening and closing the intake valve 3.

Figure 9:
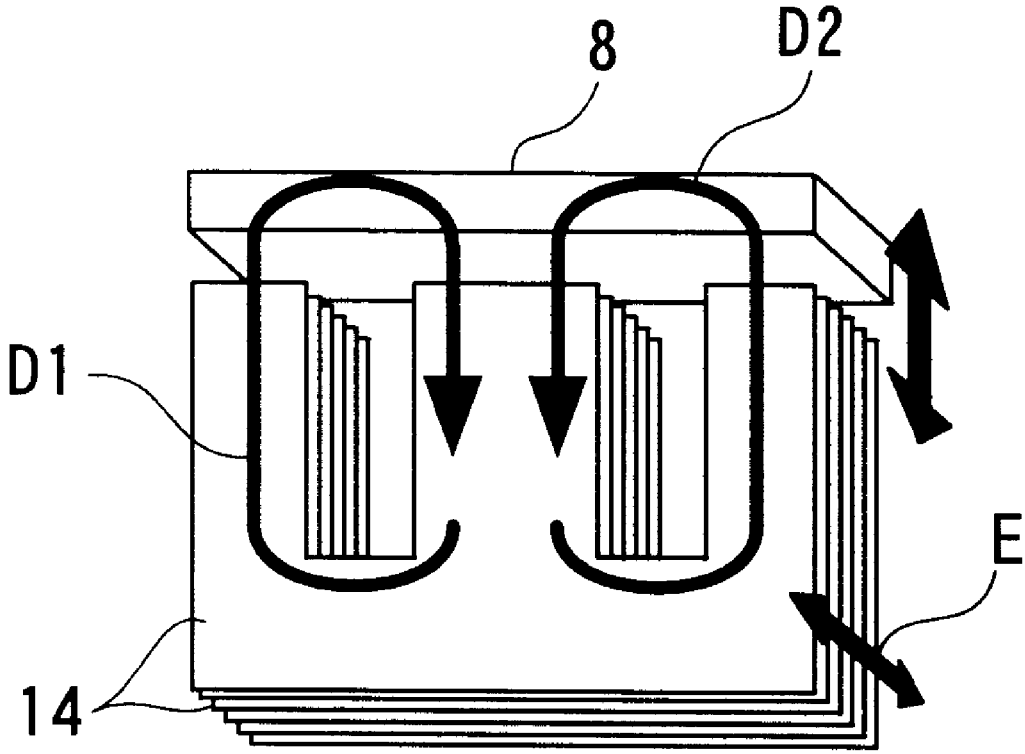
FIG. 9 is a view which is useful in explaining directions of flow of eddy currents in the core plates and directions of magnetic fluxes between the core plates and the armature, during operation of the solenoid actuator.

When the upper or lower electromagnet 1*b* is energized by electric power supplied to the coil 16 during operation of the solenoid actuator 1, magnetic circuits are formed between the armature 8 and the laminated stacks 13 of the core 10. Each of the core plates 14 forming the laminated stack 13 has the whole surface thereof coated with the insulating film 14*d* as described above, so that a magnetic circuit is formed between the armature 8 and each core plate 14 as shown in FIG. 9. More specifically, magnetic fluxes flow in respective directions indicated by arrows D in the figure, and at the same time, eddy currents are about to flow in directions indicated by a double-headed arrow E in the figure. However, the eddy currents are inhibited by the insulating films 14*d* from flowing to respective adjacent core plates 14 and disappear promptly within each thin core plate 14. Thus, it is possible to reduce core loss of the electromagnets 1*b* including an eddy current loss compared with the case where a core portion corresponding to the laminated stack 13 is formed of solid non-oriented silicon steel. Further, since the two core holders 11, 11 at the opposite ends of the core 10 are each formed of the non-magnetic material, magnetic fields are not readily generated between the core 10 and the magnetically soft components around the core 10 during operation of the solenoid actuator 1, and hence energy loss can be reduced. These features ensure high energy efficiency of the solenoid actuator.

Further, since the upper face 13*a* of each laminated stack 13 is lower than the upper faces 11*d*, 12*f* of the respective core holders 11, 12 by a predetermined height, when the armature 8 is attracted by the core 10 of the electromagnet 1*b* as shown in FIGS. 10A, 10B, the armature 8 is brought into abutment with the three core holders 11, 12, 11 alone, without being brought into contact with the laminated stacks 13, so that most of impact caused by the abutment of the armature 8 on the core 10 can be received by the core holders 11, 12, 11. Moreover, the core plates 14 are stacked in the state of the projections 14*e* of one core plate 14 being fitted in the recesses 14*f* of another core plate 14 adjacent thereto in the rightward direction, and in addition, the four rods 15 extend through the core holders 11, 12, 11 and the laminated stacks 13, which makes it possible to prevent relative vertical displacement of the core plates 14 with respect to each other due to the impact caused by the abutment of the armature 8 on the core 10. Further, since the core holders 11, 12 and the rod 15 are each formed of a highly stiff austenitic stainless steel, they cannot be deformed even if they receive the impact caused by the abutment of the armature 8 on the core 10. As described above, differently from the conventional core, the core 10 of the present embodiment makes it possible to prevent breakage of each core plate 14, thereby enhancing the durability of the core 10 in spite of its multilayer structure formed by stacking the laminates of the thin core plates 14.

Still further, in assembling the laminated stack 13 the projections 14*e* and recesses 14*f* of the core plates 14 can be used for positioning the core plates 14 with respect to each other, thereby facilitating assembly work of the laminated stack 13. Moreover, the core 10 is formed by rigidly joining the two laminated stacks 13, 13 each comprised of the predetermined number of core plates 14 stacked in the left-right direction, and the left, central, and right core holders by the rods 15 such that the two laminated stacks 13, 13 are sandwiched between the left and central core holders and between the central and right core holders, respectively, so that the core 10 can have a simpler construction than in the prior art. Additionally, a core plate 14 can be easily produced simply by stamping a flat steel sheet. These features contribute to reduction of manufacturing costs of the core 10.

Although in the above embodiment, the core holders 11, 12 and the rods 15 are each formed of the austenitic stainless steel, this is not limitative, but any other suitable non-magnetic material, such as aluminum, may be used. Further, although the core plates 14 are formed of the non-oriented silicon steel plate, this is not limitative, either, but any other suitable magnetically soft material, such as oriented silicon steel plate, may be used. Moreover, the core holders 11, 12, 11 and the laminated stacks 13 are rigidly joined into a unitary assembly by swaging the ends of the respective rods 15 extending through the three core holders and the two laminated stacks, this is not limitative, but bolts and nuts, or the like may be employed to join the core holders 11, 12, 11 and the laminated stacks 13.

Further, although in the above embodiment, description is made of an example in which the armature 8 is attracted alternately by the upper and lower electromagnets 1*b*, 1*b*, for reciprocating motion, this is not limitative, but the solenoid actuator may be configured such that it uses one electromagnet and one coil spring, for instance, to cause the armature 8 to reciprocate. Further, although the solenoid actuator 1 is applied to the valve-actuating mechanism of the vehicle engine, this is not limitative, but the solenoid actuator 1 can be applied to various driving units, including one for driving a valve for opening and closing an EGR pipe, one for driving fuel injection valves, and others for driving various kinds of driven members of the engine.

It is further understood by those skilled in the art that the foregoing is a preferred embodiment of the invention, and that various changes and modifications may be made without departing from the spirit and scope thereof.

What is claimed is:

1. A core of a solenoid actuator, for attracting an armature during operation of said solenoid actuator, comprising:

a plurality of core plates made of a magnetically soft material and stacked in a predetermined direction orthogonal to a direction of attracting said armature to form a laminated stack, for forming magnetic circuits between said armature and said core plates themselves during said operation of said solenoid actuator;

two core holders formed of a non-magnetic material and sandwiching said laminated stack of said plurality of core plates from opposite sides along said predetermined direction;

an insulator interposed between each adjacent two of said plurality of core plates, for insulating said each adjacent two core plates from each other; and fixing means formed of a non-magnetic material and rigidly securing said plurality of core plates and said two core holders to each other to form a unitary assembly, wherein said plurality of core plates are each formed with at least one projection projecting outward from a surface thereof and at least one recess each formed in a reverse side of each of said at least one projection, said at least one projection of one of said each adjacent two core plates being fitted in said at least one recess of another of said each adjacent two core plates such that said each adjacent two core plates are inhibited from relative movement with respect to each other in said direction of attracting said armature, wherein each of said plurality of core plates has a whole surface thereof coated with an insulating film, and wherein said insulator is formed by corresponding portions of said insulating films of said each adjacent two of said plurality of core plates.

2. A core of a solenoid actuator, according to claim 1, wherein said laminated stack of said plurality of core plates is formed with at least one through hole extending therethrough in said predetermined direction, and wherein said fixing means comprises at least one rod each extending through a corresponding one of said at least one through hole and fixed to said two core holders.

3. A core of a solenoid actuator, according to claim 1, wherein an upper face of said laminated stack of said plurality of core plates is lower than upper faces of said two core holders by a predetermined height.

4. A core of a solenoid actuator, according to claim 1, wherein said non-magnetic material forming said two core holders and said fixing means is an austenitic stainless steel having stiffness.

* * * * *